US005491898A

United States Patent [19]

Riley

[11] Patent Number: 5,491,898

[45] Date of Patent: Feb. 20, 1996

[54] HANDLE FOR A CENTER PUNCH

[76] Inventor: John P. Riley, 10305 SW. 131 Ct., Miami, Fla. 33186

[21] Appl. No.: 345,856

[22] Filed: Nov. 28, 1994

[51] Int. Cl.[6] ..... B26F 1/32

[52] U.S. Cl. ..... 30/366; 30/295

[58] Field of Search ..... 30/164.5, 164.6, 30/164.7, 362, 366, 367, 368, 295

[56] References Cited

U.S. PATENT DOCUMENTS 3,130,884 4/1964 Lintz .

4,833,780 5/1989 Pollock ..... 30/368

*Primary Examiner*—Douglas D. Watts

[57] ABSTRACT

A new and improved handle for a center punch comprised of a hollow tubular handle portion having a first end, a second end, and an intermediate extent therebetween. The intermediate extent has a foam padded handle theresecured. Included in the device is a hollow tubular shaft portion having a first end, a second end, and an intermediate extent therebetween. The first end is integral with the second end of the tubular handle portion. The second end is adapted to slidably receive a center punch therein. A shield portion is secured around the second end of the tubular handle portion. The shield is positioned outwardly of the foam padded handle. The shield portion has a diameter about three times greater than the tubular handle portion including the foam padded handle. The shield portion serves to protect a user's hand from the glass broken by a center punch.

2 Claims, 3 Drawing Sheets

HANDLE FOR A CENTER PUNCH

BACKGROUND OF THE INVENTION

1. Field of the Invention

The present invention relates to a handle for a center punch and more particularly pertains to providing a holder for a spring-loaded center punch so it can be used to break glass without causing injury to the hand with a handle for a center punch.

2. Description of the Prior Art

The use of punching tools is known in the prior art. More specifically, punching tools heretofore devised and utilized for the purpose of breaking glass are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,922,615 to Nishida discloses a punching tool.

U.S. Pat. No. 4,823,468 to Kollegger discloses a tool for center-punching and scribing workpieces.

U.S. Pat. No. 4,793,063 to Ducret discloses a punch gun.

U.S. Pat. No. 4,428,518 to Abel discloses a glass breaking tool.

U.S. Pat. No. 4,173,076 to Gossage discloses a scriber-compass with spring-loaded center punch.

While these devices fulfill their respective, particular objective and requirements, the aforementioned patents do not describe a handle for a center punch for providing a holder for a spring-loaded center punch so it can be used to break glass without causing injury to the hand.

In this respect, the handle for a center punch according to the present invention substantially departs from the conventional concepts and designs of the prior art, and in doing so provides an apparatus primarily developed for the purpose of providing a holder for a spring-loaded center punch so it can be used to break glass without causing injury to the hand.

Therefore, it can be appreciated that there exists a continuing need for new and improved handle for a center punch which can be used for providing a holder for a spring-loaded center punch so it can be used to break glass without causing injury to the hand. In this regard, the present invention substantially fulfills this need.

SUMMARY OF THE INVENTION

In the view of the foregoing disadvantages inherent in the known types of punching tools now present in the prior art, the present invention provides an improved handle for a center punch. As such, the general purpose of the present invention, which will be described subsequently in greater detail, is to provide a new and improved handle for a center punch and method which has all the advantages of the prior art and none of the disadvantages.

To attain this, the present invention essentially comprises a spring-loaded center punch having a first end, a second end, and an intermediate extent therebetween. The second end terminates in a pointed tip. The center punch serves to break a glass window. The device contains a hollow tubular handle portion having a first end, a second end, and an intermediate extent therebetween. The intermediate extent has a foam padded handle theresecured. The device contains a hollow tubular shaft portion having a first end, a second end, and an intermediate extent therebetween. The first end is integral with the second end of the tubular handle portion. The second end is adapted to slidably receive the first end of the spring-loaded center punch therein. A shield portion is secured around the second end of the tubular handle portion. The shield is positioned outwardly of the foam padded handle. The shield portion has a diameter about three times greater than the tubular handle portion including the foam padded handle. The shield portion serves to protect a user's hand from the glass broken by the spring-loaded center punch. The device contains a butt portion having a recess formed therein. The recess is adapted to receive the first end of the handle portion therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved handle for a center punch which has all the advantages of the prior art punching tools and none of the disadvantages.

It is another object of the present invention to provide a new and improved handle for a center punch which may be easily and efficiently manufactured and marketed.

It is a further object of the present invention to provide a new and improved handle for a center punch which is of durable and reliable construction.

An even further object of the present invention is to provide a new and improved handle for a center punch which is susceptible of a low cost of manufacture with regard to both materials and labor, and which accordingly is then susceptible of low prices of sale to the consuming public, thereby making such a handle for a center punch economically available to the buying public.

Still yet another object of the present invention is to provide a new and improved handle for a center punch which provides in the apparatuses and methods of the prior art some of the advantages thereof, while simultaneously overcoming some of the disadvantages normally associated therewith.

Even still another object of the present invention is to provide a new and improved handle for a center punch for providing a holder for a spring-loaded center punch so it can be used to break glass without causing injury to the hand.

Lastly, it is an object of the present invention to provide a new and improved handle for a center punch comprised of a hollow tubular handle portion having a first end, a second end, and an intermediate extent therebetween. The intermediate extent has a foam padded handle theresecured. Included in the device is a hollow tubular shaft portion having a first end, a second end, and an intermediate extent therebetween. The first end is integral with the second end of the tubular handle portion. The second end is adapted to slidably receive a center punch therein. A shield portion is secured around the second end of the tubular handle portion. The shield is positioned outwardly of the foam padded handle. The shield portion has a diameter about three times greater than the tubular handle portion including the foam padded handle. The shield portion serves to protect a user's hand from the glass broken by a center punch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
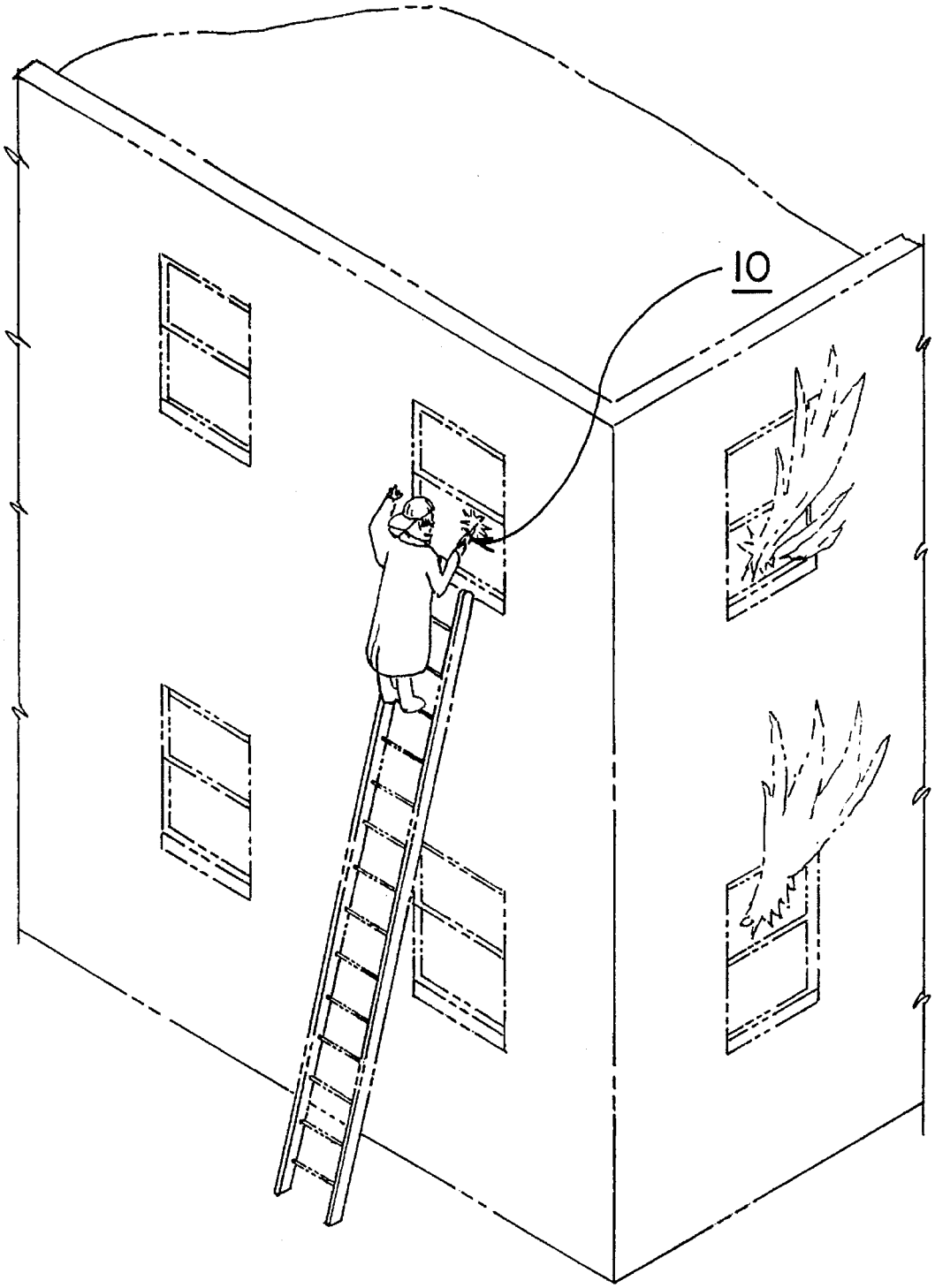
FIG. 1 is a perspective view of the preferred embodiment of the handle for a center punch constructed in accordance with the principles of the present invention in use.
Figure 2:
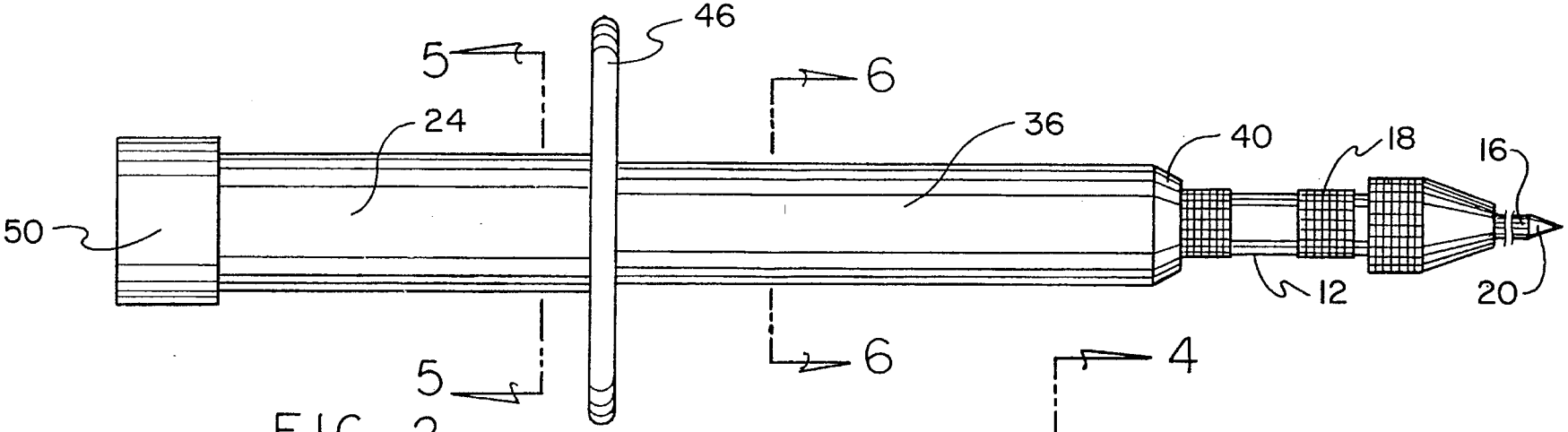
FIG. 2 is a side elevation view of the present invention.
Figure 3:
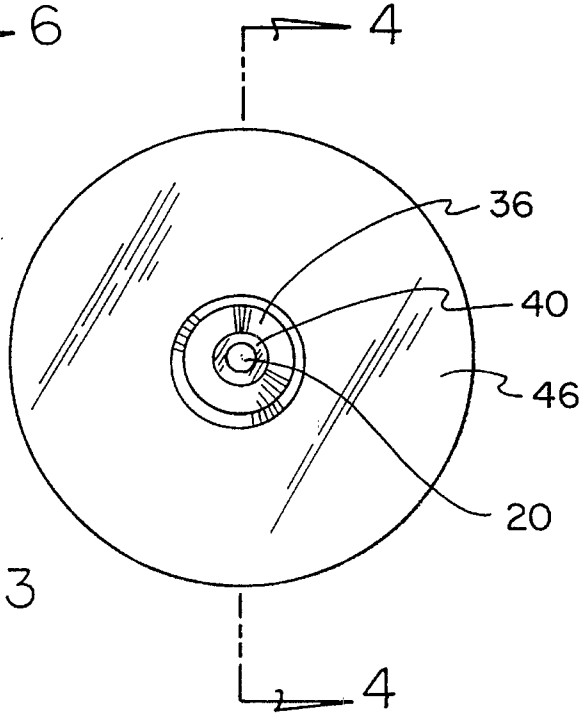
FIG. 3 is a front elevation view of the present invention.
Figure 4:
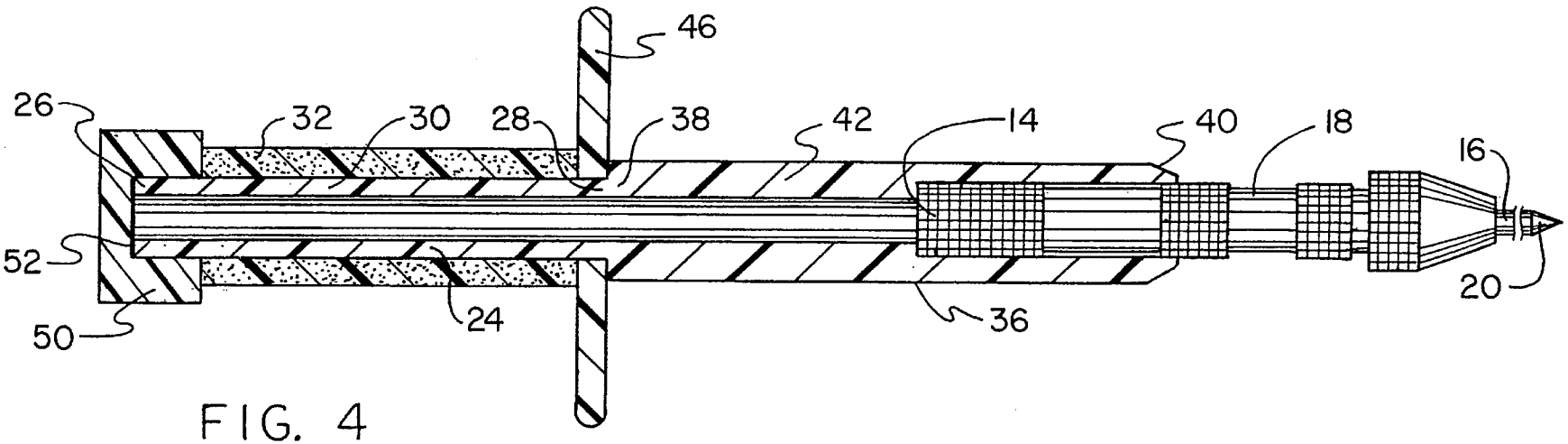
FIG. 4 is a cross-sectional view as taken along line 4—4 of FIG. 3.
Figure 6:
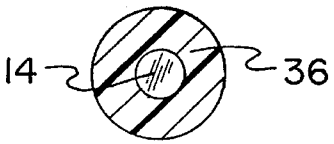
FIG. 6 is a cross-sectional view as taken along line 6—6 of FIG. 2.
Figure 5:
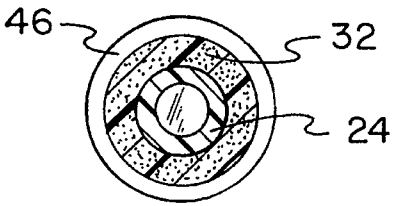
FIG. 5 is a cross-sectional view as taken along line 5—5 of FIG. 2.

With reference now to the drawings, and in particular, to FIG. 2 thereof, the preferred embodiment of the new and improved handle for a center punch embodying the principles and concepts of the present invention and generally designated by the reference number 10 will be described.

Specifically, it will be noted in the various Figures that the device relates to a new and improved handle for a center punch for providing a holder for a spring-loaded center punch so it can be used to break glass without causing injury to the hand. In its broadest context, the device consists of a spring-loaded center punch, a hollow tubular handle portion, a hollow tubular shaft portion, a shield portion, and a butt portion.

The device 10 includes a spring-loaded center punch 12 having a first end 14, a second end 16, and an intermediate extent therebetween 18. The second end 16 terminates in a pointed tip 20. The center punch 12 serves to break a glass window. The center punch 12 has a length of about five inches.

The device 10 contains a hollow tubular handle portion 24 having a first end 26, a second end 28, and an intermediate extent therebetween 30. The intermediate extent 30 has a foam padded handle 32 theresecured. The foam padded handle 32 provides the user with a comfortable means of holding the device 10.

The device 10 contains a hollow tubular shaft portion 36 having a first end 38, a second end 40, and an intermediate extent 42 therebetween. The first end 38 is integral with the second end 28 of the tubular handle portion 24. The second end 40 is adapted to slidably receive the first end 14 of the spring-loaded center punch 12 therein. The shaft portion 36 is fabricated of a hard, rigid plastic material. By receiving the the spring-loaded center punch 12 therein, only the pointed tip 20 is exposed in order to break a glass window.

A shield portion 46 is secured around the second end 28 of the tubular handle portion 24. The shield 46 is positioned outwardly of the foam padded handle 32. The shield portion 46 has a diameter about three times greater than the tubular handle portion 24 including the foam padded handle 32. The shield portion 46 serves to protect a user's hand from the glass broken by the spring-loaded center punch 12. The shield portion 46 serves to completely cover the user's hand as it grips the handle portion 24 protecting the hand from flying shards of glass.

The device 10 contains a butt portion 50 having a recess 52 formed therein. The recess 52 is adapted to receive the first end 26 of the handle portion 24 therein. The butt portion 50 is fabricated of a rigid rubber material to protect the user from the sharp edges of the first end 26 of the handle portion 24.

The present invention is a holder for a spring-loaded center punch so it can be used to break glass without causing an injury to the hand.

The holder is made of unbreakable or very strong plastic, and is tubular in shape, with a shield that protects the hand in which it is held. A long hole is provided in the outer end to accept the center punch. Only the hardened tip need be exposed. Such punches are about 5" long. Behind the shield, the handle has a rubber grip so it will not slip in the hand when the tool is used. Overall, the holder is about 10" in length.

The tool is designed for people who respond to emergencies, such as law enforcement officers and medical units. The spring-loaded center punch has been found to be very effective in breaking glass without sending shards flying through the air. It is used by placing against the glass and releasing the spring to drive the punch forward, enabling the point to shatter it. The tip acts as a stress raiser, permitting the force to be concentrated over a tiny area. Only a minimum amount of force is therefore required to create great stress on the glass.

This holder is needed because it will reduce the likelihood of injuries to the hand when the center punch is used. In emergencies, the ability to break glass quickly and positively can be very important, since some situations are life threatening, such as when people are trapped in submerged vehicles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved handle with a center punch for providing a holder for a spring-loaded center punch so it can be used to break glass without causing injury to the hand comprising, in combination:

a spring-loaded center punch having a first end, a second end, and an intermediate extent therebetween, the second end terminating in a pointed tip, the center punch serving to break a glass window;

a hollow tubular handle portion having a first end, a second end, and an intermediate extent therebetween, the intermediate extent having a foam padded handle theresecured;

a hollow tubular shaft portion having a first end, a second end, and an intermediate extent therebetween, the first end integral with the second end of the tubular handle portion, the second end adapted to slidably receive the first end of the spring-loaded center punch therein;

a shield portion secured around the second end of the tubular handle portion, the shield positioned outwardly of the foam padded handle, the shield portion having a diameter about three times greater than the tubular handle portion including the foam padded handle, the shield portion serving to protect a user's hand from the glass broken by the spring-loaded center punch;

a butt portion having a recess formed therein, the recess adapted to receive the first end of the handle portion therein.

2. A new and improved handle with a center punch for providing a holder for a spring-loaded center punch so it can be used to break glass without causing injury to the hand comprising, in combination:

a hollow tubular handle portion having a first end, a second end, and an intermediate extent therebetween, the intermediate extent having a foam padded handle theresecured;

a hollow tubular shaft portion having a first end, a second end, and an intermediate extent therebetween, the first end integral with the second end of the tubular handle portion, the second end adapted to slidably receive a center punch therein;

a shield portion secured around the second end of the tubular handle portion, the shield positioned outwardly of the foam padded handle, the shield portion having a diameter about three times greater than the tubular handle portion including the foam padded handle, the shield portion serving to protect a user's hand from the glass broken by a center punch; and a butt portion having a recess formed therein, the recess adapted to receive the first end of the handle portion therein.

* * * * *